US007086575B2

(12) United States Patent
Kimple

(10) Patent No.: US 7,086,575 B2
(45) Date of Patent: Aug. 8, 2006

(54) MAGNETICALLY OPERATED DRIVING TOOL

(76) Inventor: David W. Kimple, 1159 N. Donald La., Conway Springs, KS (US) 67031

( * ) Notice: Subject to any disclaimer, the term of this patent is extended or adjusted under 35 U.S.C. 154(b) by 0 days.

(21) Appl. No.: 11/251,362

(22) Filed: Oct. 14, 2005

(65) Prior Publication Data

US 2006/0043144 A1 Mar. 2, 2006

Related U.S. Application Data

(63) Continuation-in-part of application No. 10/833,230, filed on Jul. 30, 2004, now Pat. No. 6,955,282.

(51) Int. Cl.
*B25C 1/04* (2006.01)

(52) U.S. Cl. ..... 227/131; 227/129; 227/113; 173/202

(58) Field of Classification Search ..... 227/131, 227/132, 134, 113, 156, 129; 173/202, 114, 173/117; 310/80, 103
See application file for complete search history.

(56) References Cited

U.S. PATENT DOCUMENTS 2,943,216 A * 6/1960 Spodig ..... 310/103
2,967,302 A * 1/1961 Loveless ..... 173/117
3,609,425 A * 9/1971 Sheridan ..... 310/103
4,011,477 A * 3/1977 Scholin ..... 310/80
4,370,906 A * 2/1983 Gurries ..... 81/464
4,371,798 A * 2/1983 Kuroda ..... 310/80
4,491,262 A * 1/1985 Ewig ..... 227/131
4,511,074 A * 4/1985 Kille et al. ..... 227/113
5,584,367 A * 12/1996 Berdut ..... 188/267
6,517,560 B1 * 2/2003 Toth et al. ..... 606/171
6,796,477 B1 * 9/2004 Chen ..... 227/2

* cited by examiner

*Primary Examiner*—Scott A. Smith
(74) *Attorney, Agent, or Firm*—Dale J. Ream

(57) ABSTRACT

A magnetically operated driving tool includes a body member, first and second stator magnets at opposed ends with like poles facing one another, a movable magnet (traveler), a coupling adjacent each stator coupled to a user-operable linkage, a hammer, and a spring. A user operable linkage causes the traveler to be selectively repulsed by one stator magnet and drawn to the other. In use, a user operates the linkage, rotating the traveler until its polarity and the first stator's polarity match. The first stator magnet magnetically repulses the traveler, propelling it to the second stator magnet. In one embodiment, this action drives a fastener. Another embodiment includes metal coils for generating an electric charge for charging a battery upon movement of the traveler through the coils. Another embodiment includes air nozzles connectable to a pressure tank for compressing air upon each stroke of the traveler.

10 Claims, 10 Drawing Sheets

MAGNETICALLY OPERATED DRIVING TOOL

CROSS REFERENCE TO RELATED APPLICATIONS

This application is a continuation-in-part of and claims the benefit U.S. application Ser. No. 10/833,230, filed Jul. 30, 2004 now U.S. Pat. No. 6,955,282 entitled Magnetically Operated Driving Tool.

BACKGROUND OF THE INVENTION

This invention relates generally to driving tools and, more particularly, to a magnetically operated driving tool that does not require electric energy.

Driving fasteners such as nails, rivets, or staples is one of the most important tasks a tool can accomplish. The nail-gun, more than any other tool, is responsible for the accelerating pace and profitability of house building. Recently, many "in home" and cordless versions of tools have appeared. These devices are smaller and lighter than their industrial counterparts, yet they perform the same functions.

Various devices utilizing magnetic force as a method for propulsion have been proposed in the art. Solenoids use this force directly, as do all electric motors. In both of these cases, however, at least one of the magnets is an electric magnet. Examples of devices that use electricity with magnets for propulsion can be found in U.S. Pat. No. 3,899,703 and U.S. Pat. No. 6,232,689.

Similarly, using magnetic force to power a nail-gun is known in the art, such as in U.S. Pat. No. 4,183,453, U.S. Pat. No. 4,611,742, and U.S. Pat. No. 6,364,193. However, these devices all require an electric power source. This means that they must be corded, making them cumbersome to use and reducing their mobility, or battery operated. Batteries only provide power for a limited time, are expensive, and can leak, which causes safety concerns and can potentially ruin the tools.

Other devices are known that use magnetic force for propulsion without electricity, such as in U.S. Pat. No. 3,609,425 and U.S. Pat. No. 6,433,452, but these devices are ill suited for driving tools. U.S. Pat. No. 3,609,425 requires driven magnets that selectively intercept the established magnetic fields and drive a reciprocating magnet to its alternate position; these driven magnets would make a hand-held driving tool bulky and cumbersome to use, and it is unclear that this device would supply sufficient instantaneous force to drive a fastener. U.S. Pat. No. 6,433,452 does not deliver a single burst of propulsion as is needed for a driving tool; instead, a rotatable balance wheel rotates continuously to maintain rotation of an output shaft.

Therefore, it is desirable to have a magnetically operated driving tool that provides sufficient instantaneous force to drive a fastener, does not require electric energy, is light, compact, and easy to use, and can be easily manufactured. It would also be desirable to have a magnetically operated tool that can generate electric charge for a battery or compressed air for a pressure tank.

SUMMARY OF THE INVENTION

A magnetically operated driving tool for use in inserting fasteners according to the present invention includes a body member having a generally tubular configuration, first and second stationary (stator) magnets mounted in a spaced apart relationship at opposed ends of the body member with like poles facing one another, a movable magnet freely positioned in the body member for magnetically induced movement between the stator magnets, a coupling positioned adjacent each respective stator magnet for engaging the movable magnet when the movable magnet is magnetically coupled to the respective stator magnet, a user-operable linkage coupled to the couplings for selectively rotating the movable magnet until the polarity of the movable magnet is the same as the polarity of the respective stator magnet, a hammer slidably mounted in the body member, and a spring positioned in the body member.

In use, the movable magnet is initially magnetically coupled to the first stator magnet and engaged with the first coupling, and a fastener is held by the hammer. A user then operates the linkage, causing the movable magnet to rotate until its polarity is the same as the polarity of the first stator magnet. The movable magnet is then magnetically repulsed from the first stator magnet and moves to the second stator magnet. Before reaching the second stator magnet, the movable magnet propels the hammer from a retracted configuration to an extended configuration, thus inserting the fastener. When the movable magnet reaches the second stator magnet, it is magnetically coupled to the second stator magnet and engaged with the second coupling. The user again operates the linkage, causing the movable magnet to rotate until its polarity is the same as the polarity of the second stator magnet. The movable magnet is then magnetically repulsed from the second stator magnet and moves to the first stator magnet. Before reaching the first stator magnet, the movable magnet engages the spring, which stores the energy of the moving magnet and dampens the blow of the moving magnet. When the movable magnet reaches the first stator magnet, it is magnetically coupled to the first stator magnet and engaged with the first coupling, returning the magnetically operated driving tool to its initial configuration.

Therefore, a general object of this invention is to provide a magnetically operated driving tool that provides sufficient instantaneous force to drive a fastener.

Another object of this invention is to provide a magnetically operated driving tool, as aforesaid, that does not require electricity.

Still another object of this invention is to provide a magnetically operated driving tool, as aforesaid, that is light and compact.

Yet another object of this invention is to provide a magnetically operated driving tool, as aforesaid, that is easy to use.

A further object of this invention is to provide a magnetically operated driving tool, as aforesaid, that is easily and cost-effectively manufactured.

A still further object of this invention is to provide a magnetically operated driving tool, as aforesaid, that may include metal windings or coils for generating an electric charge.

Still another object of this invention is to provide a magnetically operated driving tool, as aforesaid, that may include air nozzle for operation as an air compressor.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
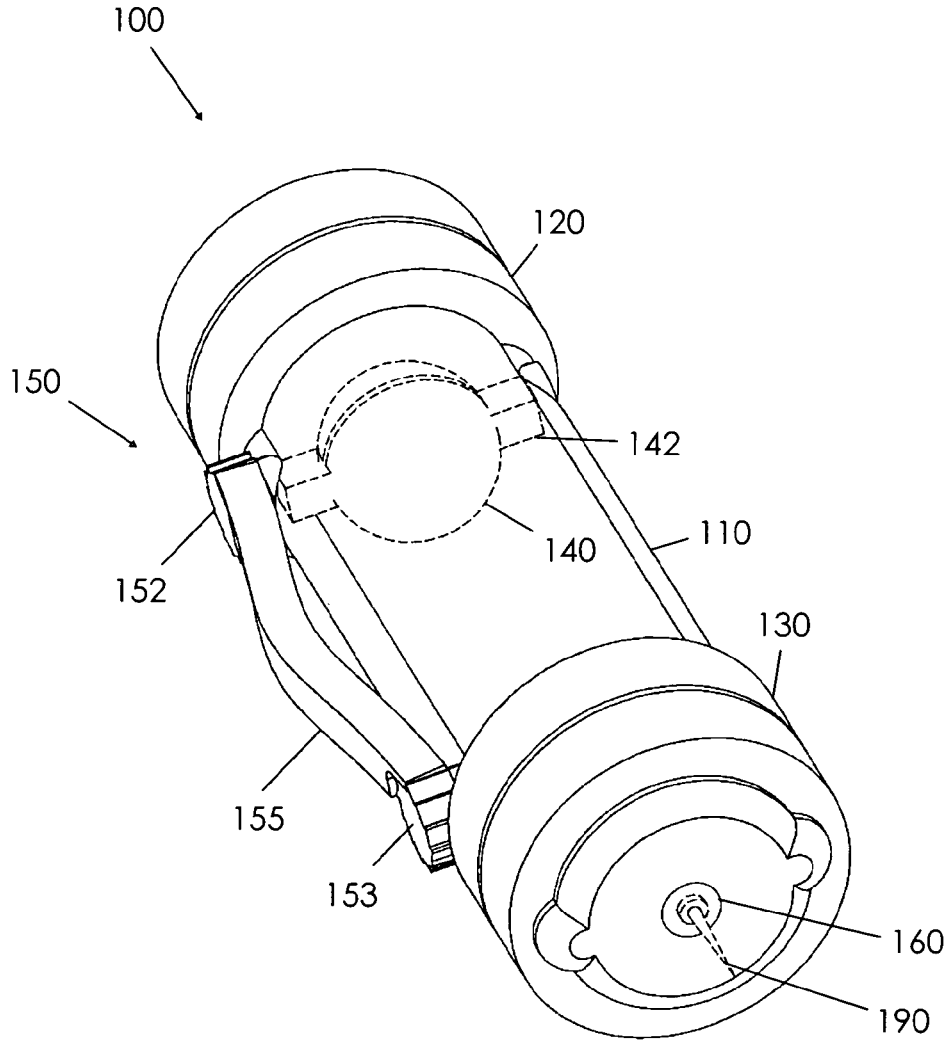
FIG. 1 is a front perspective view of a magnetically operated driving tool according to a now preferred embodiment of the present invention with a fastener.
Figure 2:
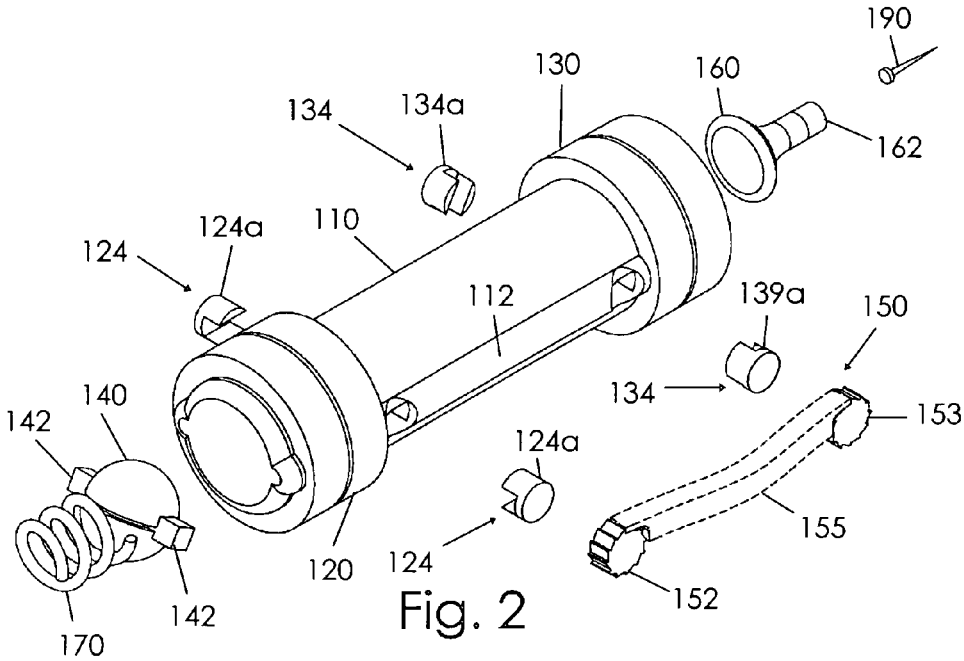
FIG. 2 is an exploded view of the magnetically operated driving tool as in FIG. 1 with a fastener.
Figure 3:
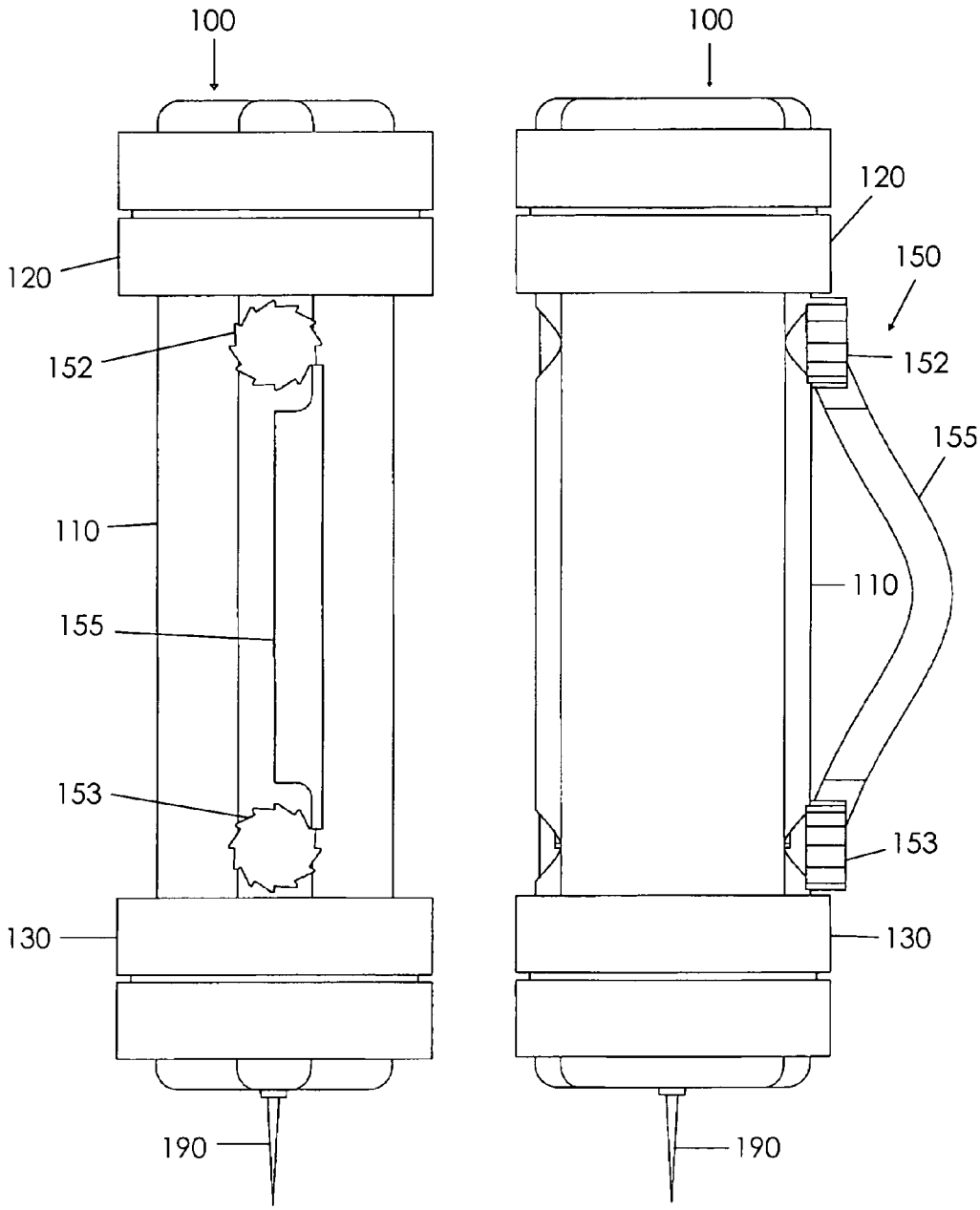
FIGS. 3*a* and 3*b* are top and side views, respectively, of the magnetically operated driving tool as in FIG. 1 with a fastener and with the handle released.
Figure 4:
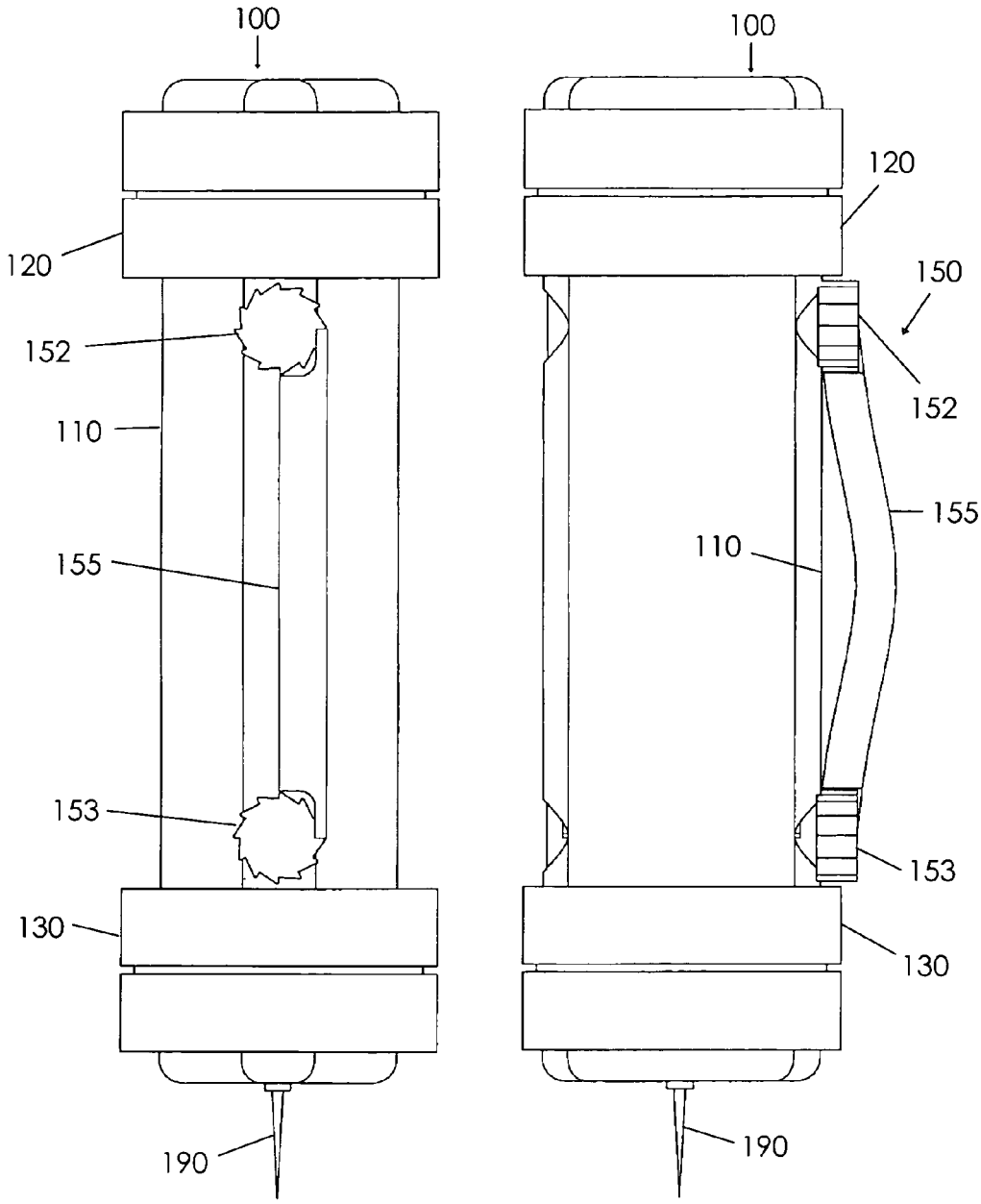
FIGS. 4*a* and 4*b* are top and side views, respectively, of the magnetically operated driving tool as in FIG. 1 with a fastener and with the handle squeezed.
Figure 5:
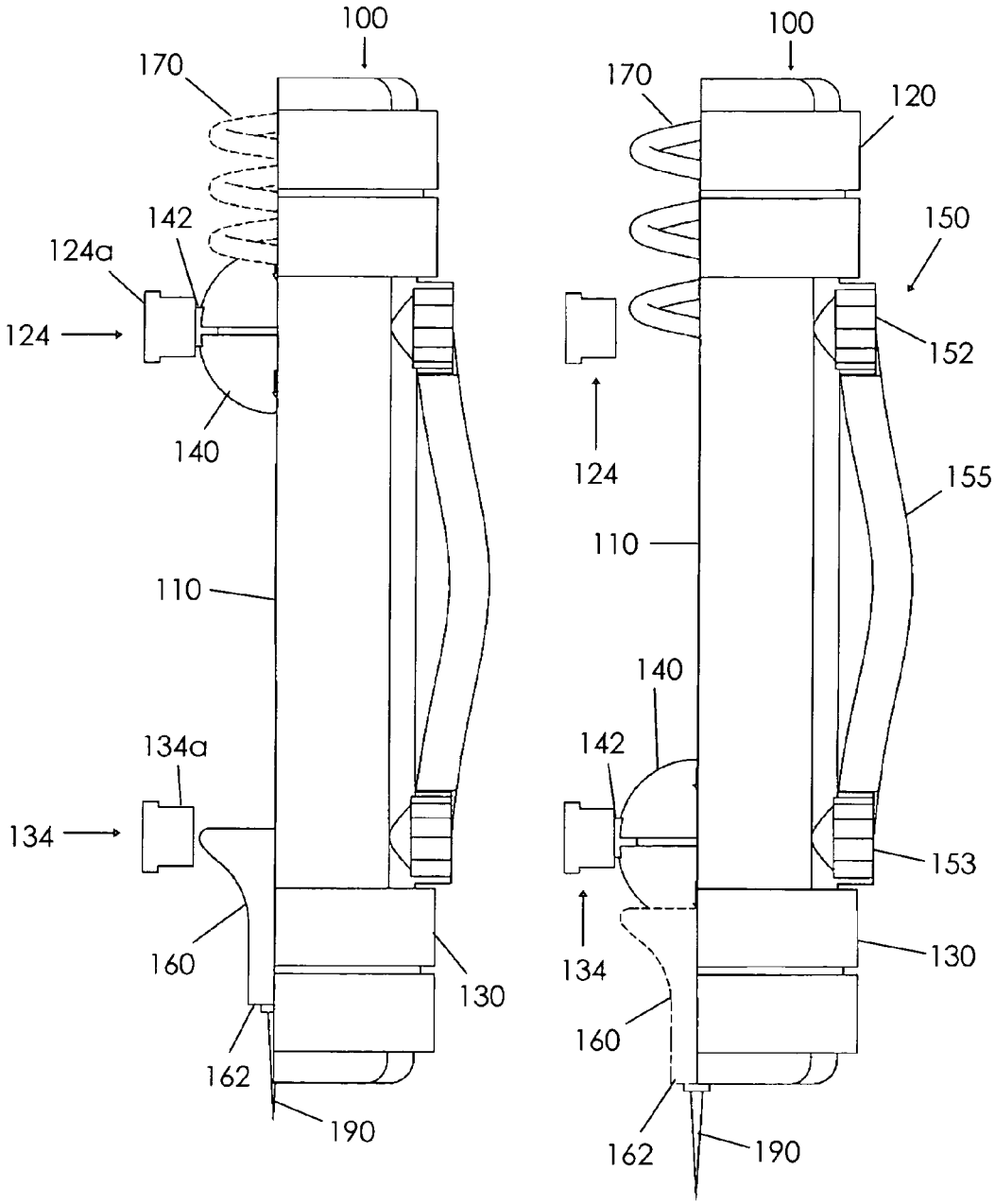
FIGS. 5*a* and 5*b* are partial side views of the magnetically operated driving tool as in FIG. 1 with a fastener, showing the movement of a movable magnet from a first stator magnet to a second stator magnet.

A magnetically operated driving tool according to the present invention will now be described in detail with reference to FIGS. 1 through 6*c* of the accompanying drawings. More particularly, a magnetically operated driving tool 100 according to a now preferred embodiment includes a body member 110 having a generally tubular configuration, first and second stationary (stator) magnets 120, 130 mounted in a spaced apart relationship at opposed ends of the body member 110 with like poles facing one another, and a moveable magnet 140 positioned in the body member 110 for magnetically induced movement between the stator magnets 120, 130 (FIGS. 1 and 2). Preferably, the stator magnets 120, 130 have generally ring-shaped configurations such that the movable magnet 140 may pass therethrough for engagement with other components as will be further described later. First and second couplings 124, 134 are positioned in the body member 110 adjacent the first and second stator magnets 120, 130, respectively, for engaging the movable magnet 140 when the movable magnet 140 is magnetically coupled to the respective stator magnet 120, 130. A user-operable linkage 150 is connected to the couplings 124, 134 for selectively rotating the movable magnet 140 until the polarity of the movable magnet 140 is the same as the polarity of the nearest respective stator magnet 120, 130.

The body member 110 preferably includes a channel 112 extending longitudinally between the first and second stator magnets 120, 130, and the first and second couplings 124, 134 are preferably first and second slotted nuts 124*a*, 134*a* rotatably mounted in the channel 112. Other couplings can be used, however. The movable magnet 140 preferably includes a flange 142 configured for sliding along the channel 112 and nesting in the respective slotted nuts 124*a*, 134*a*. The slotted nuts 124*a*, 134*a* can be best seen in FIG. 2 and FIGS. 6*a* through 6*c*.

Figure 6A:
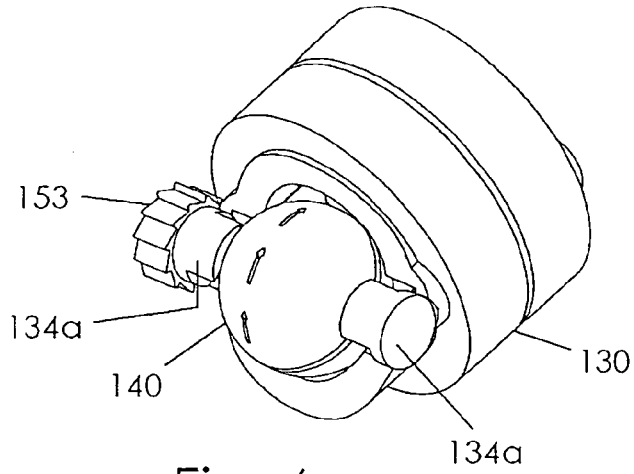
FIG. 6*a* is an isolated perspective view showing the rotation of a movable magnet.
Figure 6B:
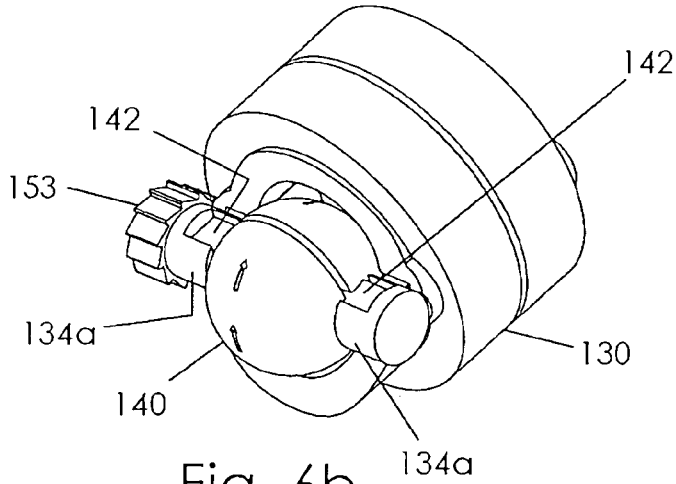
FIG. 6*b* is an isolated perspective view further showing the rotation of a movable magnet.
Figure 6C:
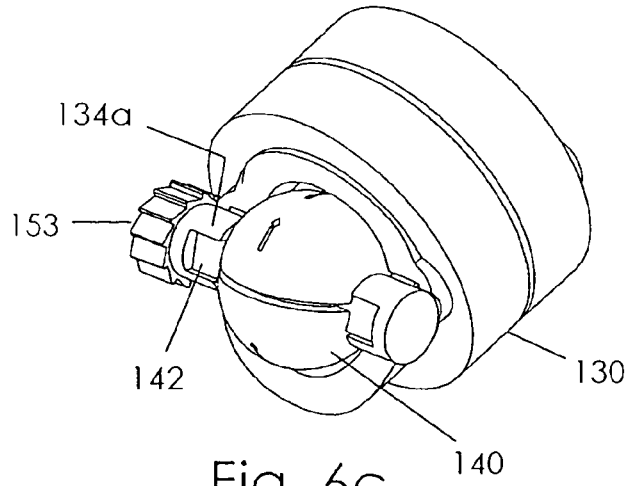
FIG. 6*c* is an isolated perspective view still further showing the rotation of a movable magnet.

The user-operable linkage 150 preferably includes a first ratchet 152 operatively connected to the first coupling 124, a second ratchet 153 operatively connected to the second coupling 134, and a handle 155 made of a resilient material operatively connecting the two ratchets 152, 153 (FIG. 2). When the handle 155 is squeezed (FIGS. 4*a* and 4*b*), the handle 155 rotates the ratchets 152, 153, causing the couplings 124, 134 to rotate. The rotation of the couplings 124, 134 causes the movable magnet 140 to rotate (FIGS. 6*a*–6*c*). When the handle 155 is released, it returns to its initial position (FIGS. 3*a* and 3*b*) due to the handle's resilient material construction. Depending on the number of teeth on the ratchets 152, 153, it may take four to six squeezes of the handle 155 to rotate the movable magnet 140 one hundred and eighty degrees. Of course, other linkages would also be suitable (not shown). For example, sprockets could be operatively connected to the couplings 124, 134, and a chain would be used to connect the sprockets. A sprocket could then be rotated in a conventional manner to rotate both couplings 124, 134. This same basic linkage could also be accomplished using pulleys and a belt or a gear train (not shown). These alternatives are relatively bulky, however, which reduces the compact character of the present invention. As another example, a linkage could connect the couplings 124, 134, and a lever could be used to rotate the couplings 124, 134. This could create a mechanical advantage to magnify the user's input of force. Other suitable linkages may be used as well as the above examples are only illustrative.

A hammer 160 is slidably mounted in the body member 110 proximate the second stator magnet 130 such that the movable magnet 140 propels the hammer 160 from a retracted configuration to an extended configuration when the movable magnet 140 travels from the first stator magnet 120 (FIG. 5*a*) to the second stator magnet 130 (FIG. 5*b*). The hammer 160 preferably includes a magnetized tip 162 capable of holding a metal fastener 190 by magnetic attraction, and a magnetic attraction preferably exists between the magnetized tip 162 and the second stator magnet 130 such that the hammer 160 is normally biased to the retracted configuration. Further, the polarity of the magnetized tip 162 is the same as the polarity of the movable magnet 140 when the movable magnet 140 travels from the first stator magnet 120 to the second stator magnet 130, thus repulsing the hammer 160. The magnetized tip 162 allows any type of metal fastener 190 with a head to be used unlike traditional nail guns, which only fire specially prepared nails. Nevertheless, the hammer 160 does not have to include a magnetized tip 162, as the hammer 160 could include a special fastener holder that is not magnetized. This special fastener holder would be required for fasteners without heads, such as finish nails and brads.

A spring 170 is positioned in the body member 110 proximate the first stator magnet 120 such that the movable magnet 140 engages the spring 170 when the movable magnet 140 travels from the second stator magnet 130 to the first stator magnet 120. This construction is illustrated in FIGS. 2, 5*a*, and 5*b*. Though the spring 170 is beneficial (as described below,) it is not essential for the preferred operation of the present invention.

In use, the magnetically operated driving tool 100 begins in an initial configuration with the movable magnet 140 magnetically coupled to the first stator magnet 120 and the hammer 160 in the retracted configuration. A user then introduces a fastener 190, which is held by the hammer 160 (FIG. 1). The user then operates the linkage 150, causing the movable magnet 140 to rotate as described above (FIGS. 3*a* to 4*b* and FIGS. 6*a*–6*c*) until its polarity is the same as the polarity of the first stator magnet 120. The movable magnet 140 is then magnetically repulsed from the first stator magnet 120 and released from the first coupling 124, causing the movable magnet 140 to travel to the second stator magnet 130, it being understood that the path of the movable magnet 140 is guided by the flange 142 traveling along the channel 112. The spring 170 also releases potential energy to further power the movable magnet 140 in its travel from the first stator magnet 120 to the second stator magnet 130, and the second stator magnet 130 exerts an attractive force on the movable magnet 140 to even further power the movable magnet 140 in its travel. Before the movable magnet 140 reaches the second stator magnet 130, the movable magnet 140 propels the hammer 160 from the retracted configuration to the extended configuration, thus inserting the fastener 190. When the movable magnet 140 reaches the second stator magnet 130, the movable magnet 140 is magnetically coupled to the second stator magnet 130 and engaged with the second coupling 134. The movement of the movable magnet 140 from the first stator magnet 120 to the second stator magnet 130 is shown in FIGS. 5*a* and 5*b*. The user again operates the linkage 150, causing the movable magnet 140 to rotate until its polarity is the same as the polarity of the second stator magnet 130. The movable magnet 140 is then magnetically repulsed from the second stator magnet 130 and released from the second coupling 134, causing the movable magnet 140 to travel to the first stator magnet 120. The first stator magnet 120 exerts an attractive force on the movable magnet 140 to further power the movable magnet 140 in its travel from the second stator magnet 130 to the first stator magnet 120. Before the movable magnet 140 reaches the first stator magnet 120, the movable magnet 140 engages the spring 170. The spring 170 dampens the blow of the movable magnet 140 and stores kinetic energy from the movable magnet 140 as potential energy. When the movable magnet 140 reaches the first stator magnet 120, the movable magnet 140 is magnetically coupled to the first stator magnet 120 and engaged with the first coupling 124, returning the magnetically operated driving tool 100 to its initial configuration.

A magnetically operated driving tool (not shown) according to another embodiment of the present invention includes a construction substantially similar to the construction previously described except as specifically noted below. More particularly, the magnetically operated driving tool according to this embodiment includes conventional methods for rotating the couplings 124, 134 individually instead of employing the user-operable linkage 150.

Figure 7A:
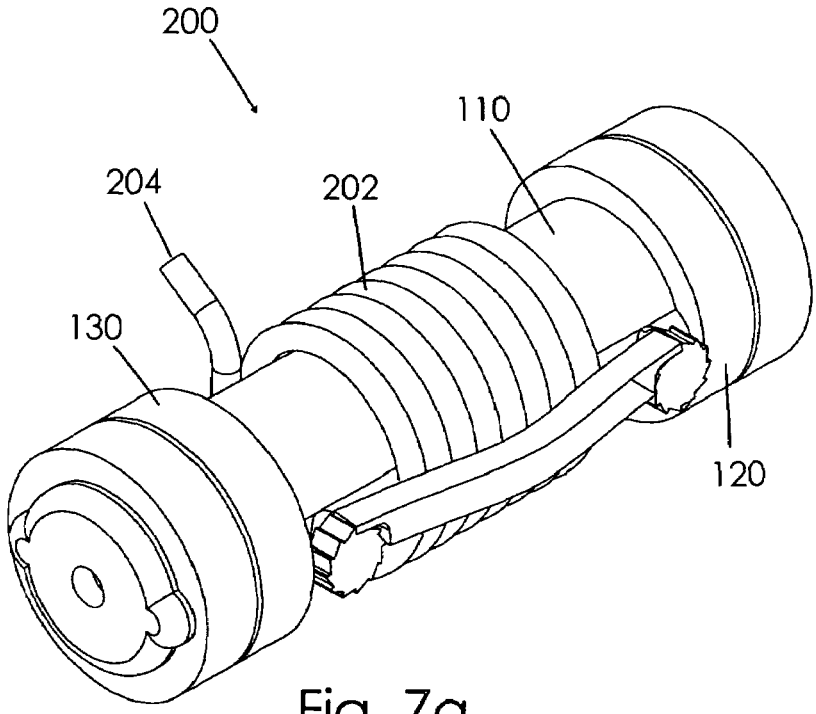
FIGS. 7*a* and 7*b* are perspective and side views, respectively, of a magnetically operated driving tool according to another embodiment of the invention having metal coils for generating an electric charge.
Figure 7B:
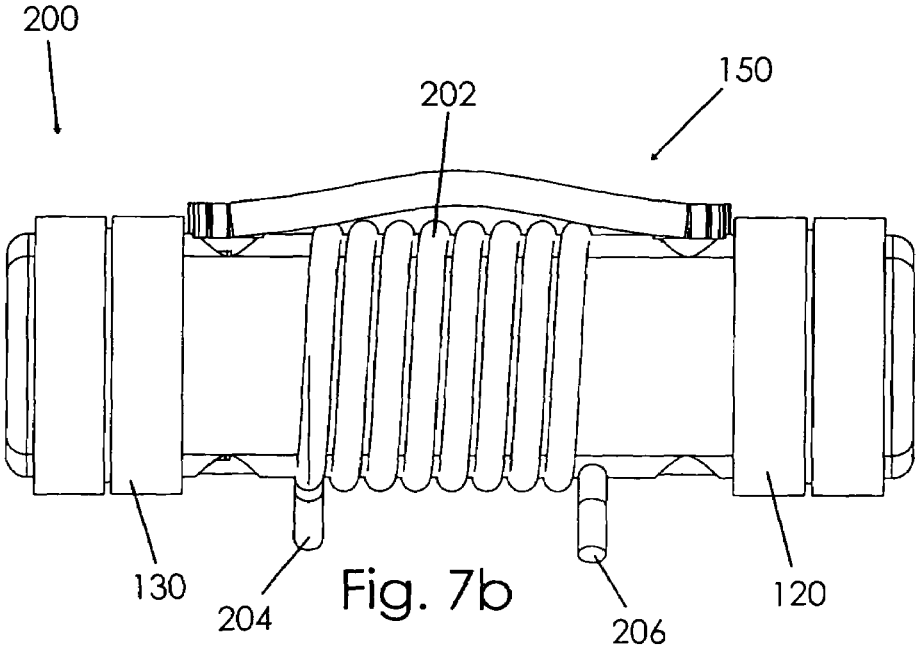
Figure 8:
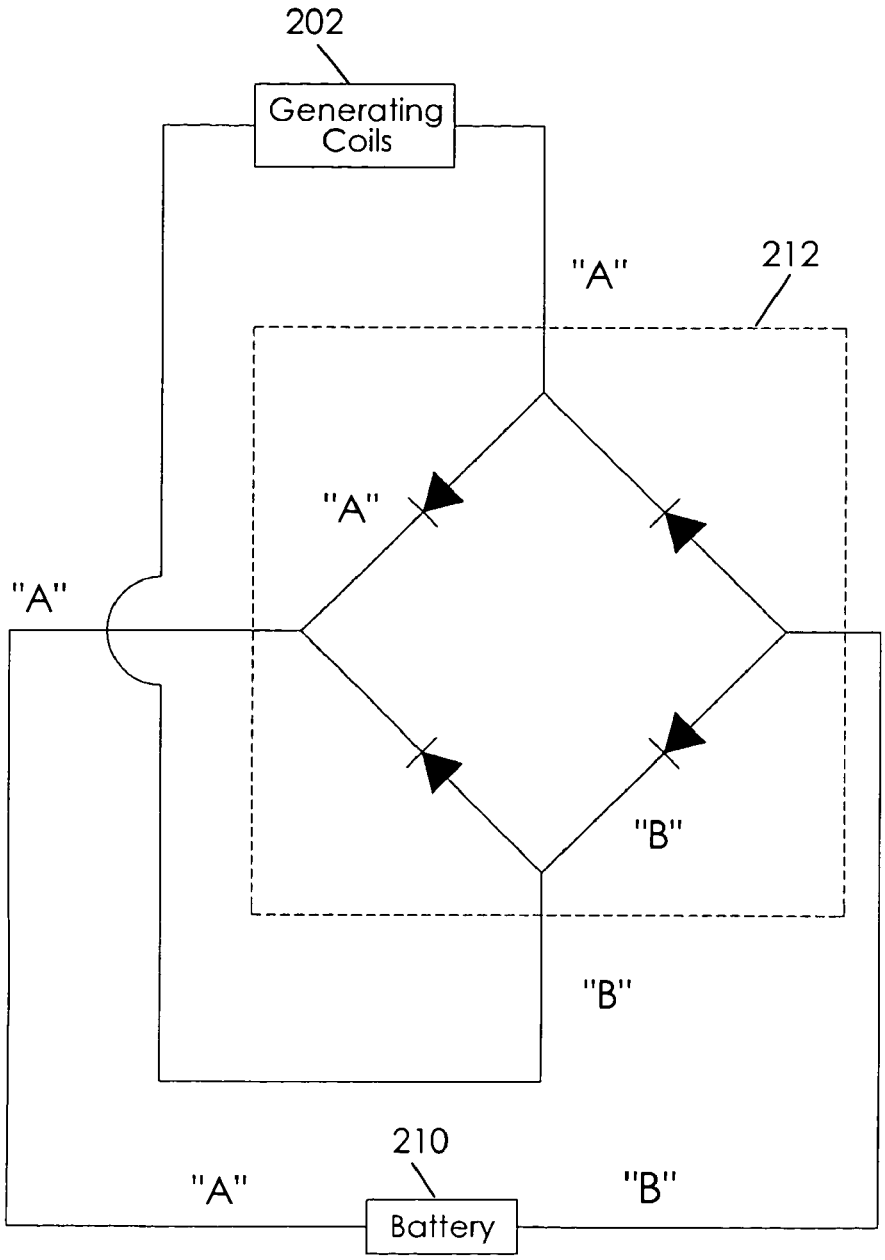
FIG. 8 is a schematic diagram showing operation of the device as in FIGS. 7*a* and 7*b;*

A magnetically operated driving tool 200 according to yet another embodiment of the present invention is shown in FIGS. 7*a* through 8 and includes a construction that is substantially similar to the construction first described above except as specifically noted below. More particularly, a plurality of metal coils 202 (also referred to herein as conductive stator windings) are coiled about the exterior of the body member 110 between the stator magnets 120, 130. The coils 202 include opposed ends 204, 206 suitable for attachment to a battery 210 or other external power source (FIG. 8).

It is well known that movement of a magnet through conductive coils generates a positive electric voltage. In operation, therefore, and as shown schematically in FIG. 8, the invention according to this embodiment, when operably connected to a battery 210 and rectifier 212 with wires, may be utilized to generate a positive electric voltage and store it in the battery 210 for later application. Upon one stroke of the movable magnet 140 between the stator magnets 120, 130, a positive electric voltage is generated. Upon passage through the rectifier 212, the positive electric voltage is directed to the battery 210 for storage. In FIG. 8, this functionality is referenced as path "A". Simultaneously with a stroke of the movable magnet 140, a negative voltage is accessed from the battery 210 and directed to the coils 202 for conversion/alternation to a positive voltage on the next successive movement of the movable magnet 140. This operation is referenced in FIG. 8 as path "B". Therefore, it should be understood that as the movable magnet 140 is alternated between the stator magnets 120, 130 as described previously, positive voltages are repeatedly generated and stored in a battery 210 for later use. One useful application of this embodiment may be to charge a battery in a camping environment so as to power a flashlight or small motor.

Figure 9A:
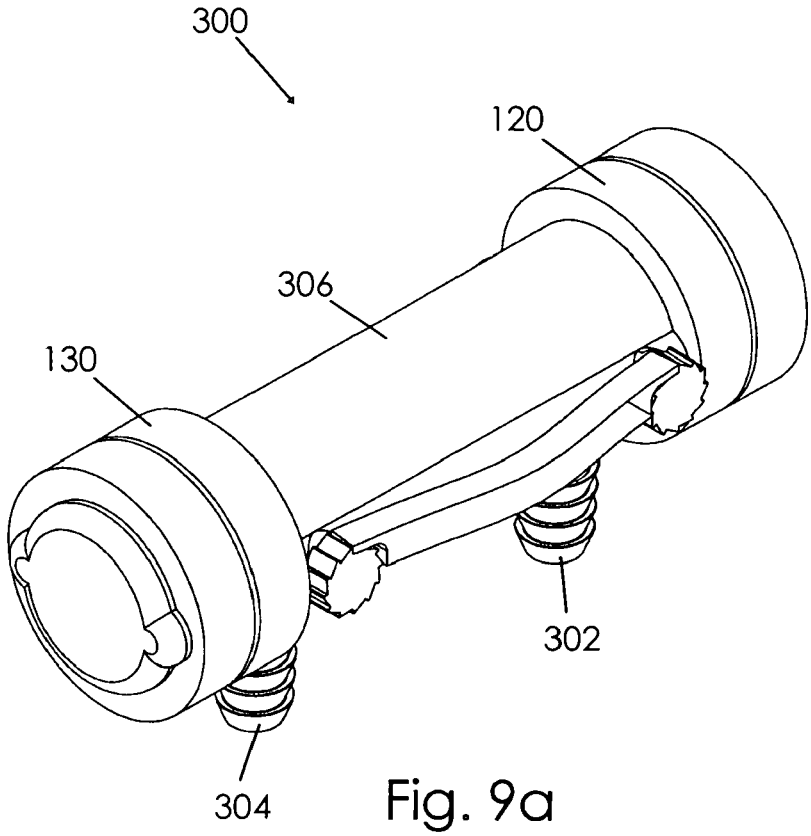
FIGS. 9*a* and 9*b* are perspective and side views, respectively, of a magnetically operated driving tool according to another embodiment of the invention having air nozzles for operation as an air compressor.
Figure 9B:
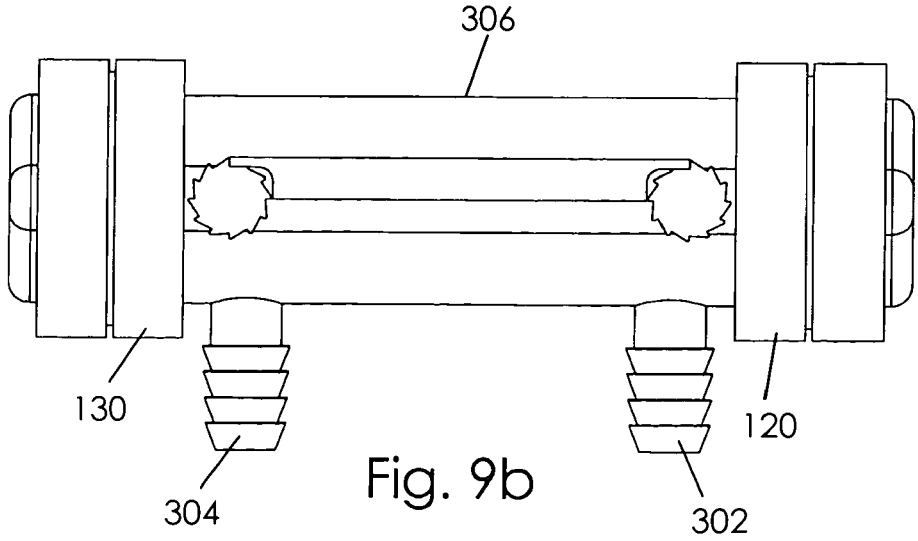
Figure 10:
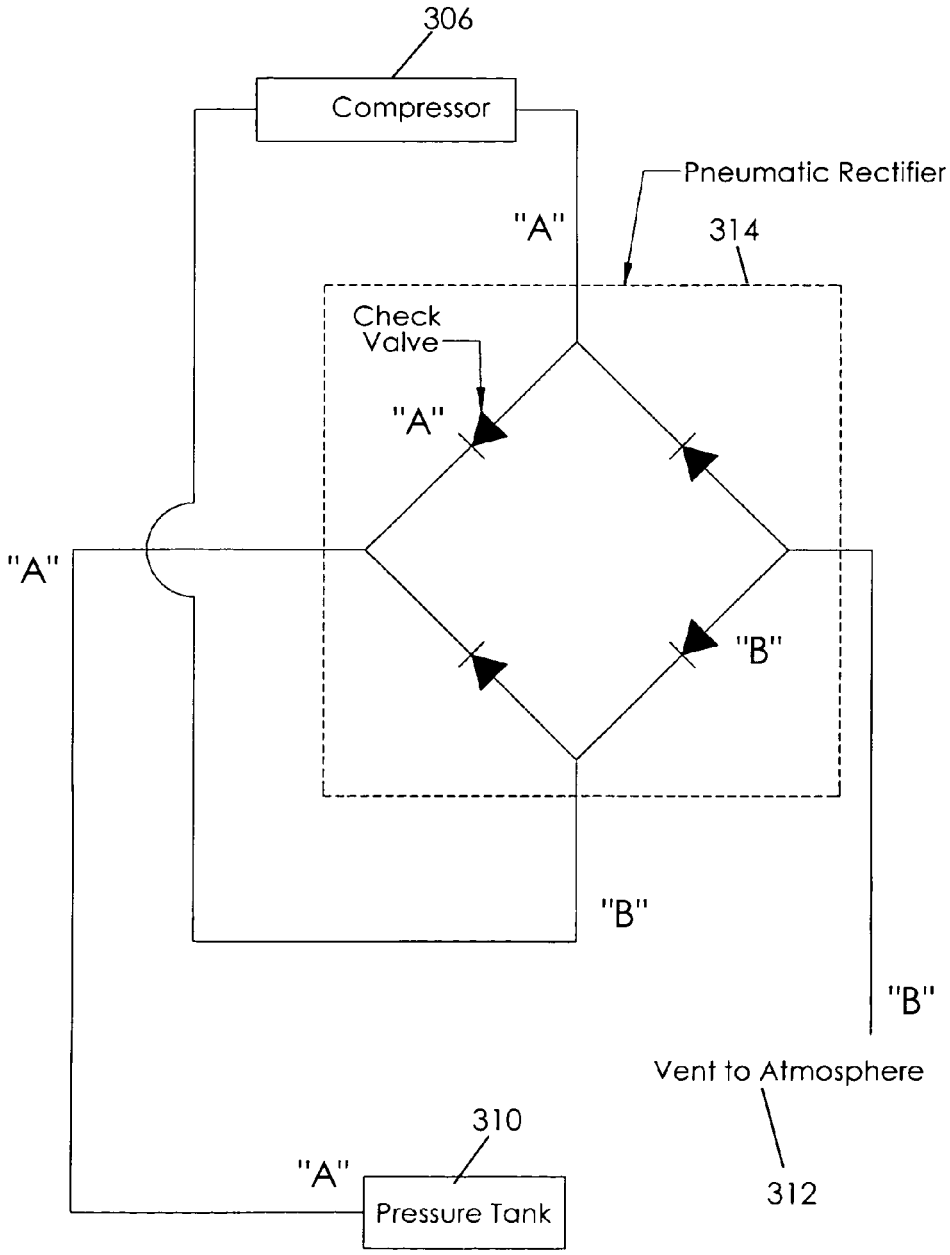
FIG. 10 is a schematic diagram showing operation of the device as in FIGS. 9*a* and 9*b*.

A magnetically operated driving tool 300 according to still another embodiment of the present invention is shown in FIGS. 9*a* through 10 and includes a construction that is substantially similar to the construction first described above except as specifically noted below. More particularly, this embodiment of the invention includes first 302 and second 304 air nozzles extending outwardly from the air compressor/body member 306 and situated inwardly adjacent respective stator magnets 120, 130. Each nozzle is capable of communicating an air stream into or out of the body member 306, as will be further described below. In use, these nozzles would be connected to a pressure tank 310 with hoses (not shown) and would include appropriate valve assemblies for access to ambient air 312.

In a two stroke manner similar to the process described above relative to the coils, this embodiment of the invention is capable of operating as an air compressor with pneumatic rectifier 314 for incrementally charging a remote air pressure tank 310. More particularly, when the movable magnet 140 moves from stator magnet 120 toward magnet 130, air within the body member 110 (inside the so-called "compressor") is directed through the nozzle 304 adjacent magnet 130 and into the pressure tank 310. In FIG. 10, this action is denoted by reference letter "A". Simultaneously, the movement of magnet 140 toward stator magnet 130 causes an air stream to be drawn into the housing/air compressor 306 through nozzle 302 adjacent stator magnet 120. This action is denoted by reference letter "B".

Upon the next movement of magnet 140 from stator magnet 130 back to stator magnet 120, the same action is taken again, only this time air is forced through the nozzle 302 adjacent stator magnet 120 into the pressure tank and a new volume of air is drawn into the compressor 306 via the nozzle 304 adjacent stator magnet 130. Accordingly, the pressure tank 310 is incrementally pressurized every time the movable magnet 140 is actuated to move between the stator magnets 120, 130 as first described above. When the pressure 310 is sufficiently pressurized, it may be used for any application that is customary for air compressors.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A magnetically operated tool, comprising:

a body member having a generally tubular configuration;

first and second stator magnets mounted in a spaced apart relationship at opposed ends of said body member, said first and second stator magnets configured with like poles facing one another;

a movable magnet freely positioned in said body member for magnetically induced movement between said first and second stator magnets, a pole of said movable magnet being magnetically attracted toward an opposite pole of a respective stator magnet;

a first coupling positioned adjacent said first stator magnet for engaging said movable magnet when said movable magnet is magnetically coupled thereto;

a user-operable linkage coupled to said first coupling for selectively rotating said movable magnet until the polarity of said movable magnet is the same as the polarity of said first stator magnet and said movable magnet is repulsed from said first stator magnet to said second stator magnet; and a plurality of metal coils attached to said body member and situated between said first and second stator magnets for generating a positive electrical voltage when said movable magnet moves between said first and second stator magnets.

2. The magnetically operated tool as in claim 1 wherein said plurality of coils is coiled about an exterior surface of said body member.

3. The magnetically operated tool as in claim 1 wherein said plurality of coils includes opposed ends, each of said opposed ends adapted for electrical connection to a battery.

4. The magnetically operated tool as in claim 3 wherein said positive electrical voltage is directed through one of said opposed ends to said battery.

5. A magnetically operated tool, comprising:

a body member having a generally tubular configuration;

first and second stator magnets mounted in a spaced apart relationship at opposed ends of said body member, said first and second stator magnets configured with like poles facing one another;

a movable magnet freely positioned in said body member for magnetically induced movement between said first and second stator magnets, a pole of said movable magnet being magnetically attracted toward an opposite pole of a respective stator magnet;

a first coupling positioned adjacent said first stator magnet for engaging said movable magnet when said movable magnet is magnetically coupled thereto;

a user-operable linkage coupled to said first coupling for selectively rotating said movable magnet until the polarity of said movable magnet is the same as the polarity of said first stator magnet and said movable magnet is repulsed from said first stator magnet to said second stator magnet; and a pair of air nozzles coupled to said body member for cooperatively forcing a volume of air from said body member through one of said pair of air nozzles and drawing a new volume of air into said body member through another of said pair of air nozzles when said movable magnet moves between said first and second stator magnets.

6. The magnetically operated tool as in claim 5 wherein said pair of nozzles includes a first nozzle extends outwardly from an exterior surface of said body member adjacent said first stator magnet and a second nozzle extends outwardly from said exterior surface of said body member adjacent said second stator magnet.

7. The magnetically operated tool as in claim 6 wherein said first and second nozzles are positioned inwardly of said first and second stator magnets, respectively, such that said movable magnet passes over respective nozzles when moving between respective stator magnets.

8. The magnetically operated tool as in claim 6 wherein said first and second nozzles include a construction for connection to a pressure tank.

9. The magnetically operated tool as in claim 8 wherein the volume of air is forced through said second nozzle into said pressure tank when said movable magnet moves from said first stator magnet toward said second stator magnet.

10. The magnetically operated tool as in claim 8 wherein the volume of air is forced through said first nozzle into said pressure tank when said movable magnet moves from said second stator magnet toward said first stator magnet.

* * * * *